US006860399B2

(12) United States Patent
Reeves

(10) Patent No.: US 6,860,399 B2
(45) Date of Patent: Mar. 1, 2005

(54) INSULATED BEVERAGE HOLDER WITH TUBULAR FLIP-TOP ENCLOSURE

(76) Inventor: Jerry W. Reeves, 3205 Lynbrook Dr., Plano, TX (US) 75075

( * ) Notice: Subject to any disclaimer, the term of this patent is extended or adjusted under 35 U.S.C. 154(b) by 0 days.

(21) Appl. No.: 10/764,226

(22) Filed: Jan. 22, 2004

(65) Prior Publication Data

US 2004/0149764 A1 Aug. 5, 2004

Related U.S. Application Data

(60) Provisional application No. 60/441,902, filed on Jan. 22, 2003.

(51) Int. Cl.[7] ..... B65D 25/34
(52) U.S. Cl. ..... 220/739; 220/903
(58) Field of Search ..... 220/737, 739, 220/903, 212.5, 756, 264, 263, 827, 810, 839

(56) References Cited

U.S. PATENT DOCUMENTS

D229,156 S 11/1973 Mousette
D273,247 S 4/1984 Pigott
5,186,350 A 2/1993 McBride
6,039,207 A 3/2000 Adamek
D474,650 S 5/2003 Reeves

*Primary Examiner*—Stephen Castellano
(74) *Attorney, Agent, or Firm*—Mark W. Handley; Chauza & Handley, L.L.P.

(57) ABSTRACT

An insulated beverage holder (12) has a tubular body (14) defined by a continuously extending sidewall (36) which is enclosed on opposite ends (16, 18) by upper and lower enclosure members (30, 32). A slit (20) extends partially through a circumferentially extending periphery of the sidewall (36) to define upper and lower portions (22, 24) of the tubular body (14), wherein the upper portion (22) defines a tubular enclosure (68) for fitting over the upper end (64) of a beverage container (62) which is disposed in the lower portion (24). A hinge portion (26) of the tubular body (14) disposed adjacent to the slit (20) pivotally connects the upper portion (22) to the lower portion (24) the tubular body (14). A tab (28) extends outward of the upper portion (22) to provide a lever for pivotally moving the upper portion (22) relative to the lower portion (24).

20 Claims, 3 Drawing Sheets

INSULATED BEVERAGE HOLDER WITH TUBULAR FLIP-TOP ENCLOSURE

CROSS-REFERENCE TO RELATED APPLICATION

The present application claims priority to U.S. Provisional Patent Application Ser. No. 60/441,902, filed Jan. 22, 2003, invented by Jerry W. Reeves, and entitled "Insulated Beverage Holder With Tubular Flip-Top Enclosure," and is related to a U.S. Design Patent Application having application Ser. No. 29/154,797, filed Jan. 28, 2002, and invented by Jerry W. Reeves, the inventor of the present application.

TECHNICAL FIELD OF THE INVENTION

The present invention relates in general to beverage holders, and in particular to an insulated beverage holder having a flip-top enclosure.

BACKGROUND OF THE INVENTION

Prior art beverage containers and beverage holders have been provided for persons to use in consuming beverages. Such beverage containers and beverage holders often provide insulation to maintain the temperature of heated and cooled beverages. One typical application provides a foam rubber beverage holder which has a tubular body, a bottom and an open top. A beverage container, such as a bottle or a can, is placed within the tubular body and the foam rubber of tubular body thermally insulates the beverage container against heat transfer from atmospheric air. After the beverage container is placed within the beverage holder, the top of the beverage container typically remains open to the atmospheric air as the beverage is being consumed. This allows atmospheric air to contact the upper, exposed portions of the beverage containers, transferring heat between the atmospheric air and the exposed portions of the beverage containers. Dust and debris in the atmospheric air may contact the beverage container, and may also contaminate beverages held within the containers.

Another problem which arises when beverages are being consumed outdoors in open top containers is that bugs and insects are often attracted to such beverages. The bugs and insects will often enter the open tops of the beverage containers, and then the bugs and insects may be ingested with the beverages if the persons consuming the beverages are not paying close attention to the open tops of the beverage containers to carefully guard the open tops of the beverage containers against such intrusions. Typically, ingestion of bugs and insects is not harmful to persons. However, severe medical trauma has resulted from bees and wasps which have flown into the open tops of beverage containers, and then have then been ingested with beverages by persons who are inattentive to guard against such intrusions into the open tops of beverage containers. Many golfers and other outdoor enthusiasts have been inattentive to open top beverage containers and then have swallowed bees and wasps which flew into the open tops of beverage containers. In many cases, the ingested bees and wasps will sting the throats of the persons in whom they are consumed, which causes swelling of the throat and constriction of breathing passages. In some cases, persons have died as a result of being stung by ingested bees and wasps.

The American Collect of Allergy, Asthma and Immunology has indicated that every year in the United States, more than 500,000 people enter hospital emergency rooms suffering from insect stings, and 40 to 150 of those entering the hospital die as a result of an allergic reaction to the stings. Many of these stings are in the victims' mouths and throats, and occur as a result of swallowing insects that flew into the open tops of beverage containers. Stings to the mouth and throat often result in swelling, which leads to many of the victims choking as the swelling constricts breathing passages in the victims' throats.

SUMMARY OF THE INVENTION

A novel insulated beverage holder is disclosed having a tubular body with open opposite ends which are enclosed by enclosure members. The tubular body is defined by a continuously extending sidewall. The tubular body has a length for receiving beverage containers of a selected size, between the upper and lower ends of the tubular body. A slit extends through the tubular body, spaced apart from the upper end of the tubular body and extending at least partially around a circumferentially extending peripheral portion of the tubular body. The slit defines upper and lower portions of the tubular body, and rims for the upper and lower portions of the tubular body. The upper and lower portions define tubular enclosures, wherein a bottom end of a beverage container fits within the lower portion of the tubular body, and the upper portion of the tubular body defines a tubular enclosure which fits over an upper end of the beverage container which protrudes outward of the lower portion of the tubular body. A hinge portion pivotally connects the upper portion of the tubular body to the lower portion the tubular body. A tab extends outward of the upper portion of the tubular body to provide a lever for pivotally moving the upper portion relative to the lower portion, opening and closing the tubular body of the beverage holder. An aperture extends through the bottom of the lower enclosure member for equalizing pressure sealed between the interior of the sidewall of the insulated beverage holder and the periphery of the beverage container disposed within the tubular body.

DESCRIPTION OF THE DRAWINGS

For a more complete understanding of the present invention and the advantages thereof, reference is now made to the following description taken in conjunction with the accompanying Drawings which show various aspects for insulated beverage holder made according to the present invention, as set forth below.

DETAILED DESCRIPTION OF THE INVENTION

Figure 1:
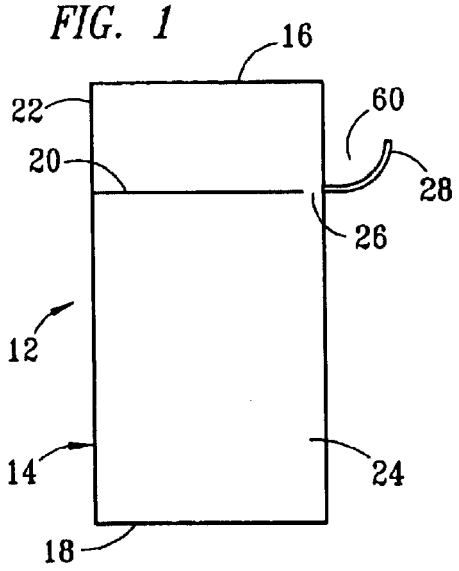
FIG. 1 is a front, elevation view of an insulated beverage holder, with an upper portion in a closed position relative to a lower portion of a tubular body of the insulated beverage holder.

FIG. 1 is a front, elevation view of an insulated beverage holder 12 having a tubular body 14. The tubular body 14 includes an open upper end 16 and an open lower end 18. A planar slit 20 extends into a circumferentially extending portion of the tubular body 14 to define an upper portion 22 and a lower portion 24 of the tubular body 14. The upper portion 22 and the lower portion 24 of the tubular body 14 define tubular enclosures, having oppositely facing, open ends which mate around respective upper and lower ends of beverage containers to enclose the beverage containers. The tubular body 14 is preferably formed of elastomeric materials, such a neoprene, which will have some stretch and conform to the shape and size of the beverage containers enclosed within the tubular upper portion 22 and the tubular lower portion 24. The upper portion 22 is shown disposed in a closed position relative to the lower portion 24 of the tubular body 14, registering with and disposed directly adjacent to the top of the lower portion 24. The slit or opening 20 does not extend all of the way through the tubular body 14, but stops prior to entering a flexible portion 26 of the tubular body 14, which defines a hinge. The flexible hinge portion 26 pivotally connects the tubular, upper portion 22 to the tubular lower portion 24 of the tubular body 14, such that the upper portion 22 may be angularly displaced relative to the lower portion 24 for fitting over the upper end 64 of a container enclosed within the tubular body 14. (See FIG. 6). A tab 28 extends outward of the upper portion 22, proximate to the hinge portion 26 to provide a lever arm which a user may engage to angularly move the upper portion 22 relative to the lower portion 24, to provide one-handed operation of the insulated beverage holder 12.

Figure 2:
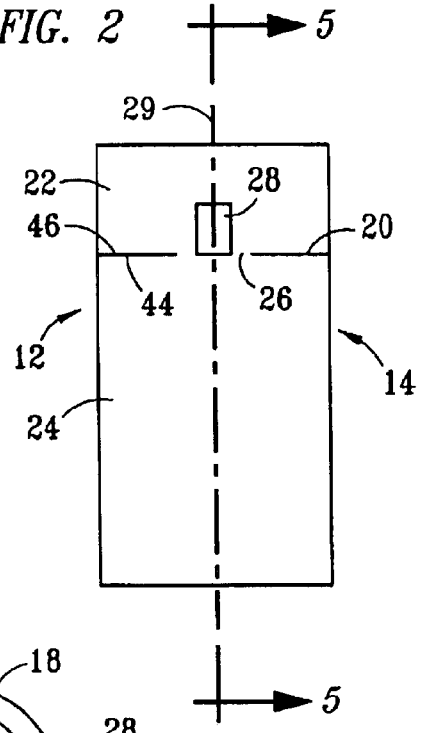
FIG. 2 is side elevation view of the insulated beverage holder, with the upper portion shown in a closed position relative to the lower portion.

FIG. 2 is side elevation view of the insulated beverage holder 12, showing the upper portion 22 in a closed position relative to the lower portion 24 of the tubular body 14. Preferably the tubular body 14 is of cylindrical shape and defines a longitudinal axis 29. The slit 20 is shown extending into the tubular body 14, in a plane which is perpendicular to a longitudinal axis 29 of the tubular body 14. The slit 20 defines a rim 44 of the upper portion 22 and a rim 46 of the lower portion 24, with the rims 44 and 46 being opposed to one another, that is, facing in opposite directions. The rims 44 and 46 fit flush and register with one another when the tubular-shaped upper portion 22 is in the closed position relative to the tubular-shaped lower portion 24 of the beverage holder 12.

Figure 3:
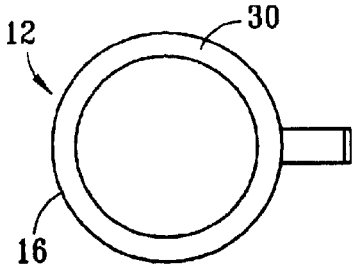
FIG. 3 is top view of the insulated beverage holder.

FIG. 3 is top view of the insulated beverage holder 12, showing an upper enclosure member 30 secured in the open upper end 16, enclosing the upper end 16 of the tubular body 14. Preferably, the enclosure member 30 fits flush against an interior of the upper end 16 to fully enclose the upper end 16. The upper enclosure member 30 is preferably a planar member having a periphery 38 of cylindrical shape which defines a disk that is adhesively secured in the upper end 16 of the tubular body 14. The upper enclosure member 30 is preferably formed of a flexible, elastomeric material, such as a neoprene rubber.

Figure 4:
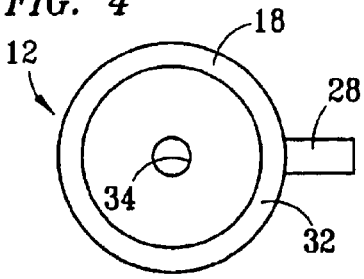
FIG. 4 is a bottom view of the insulated beverage holder.
Figure 5:
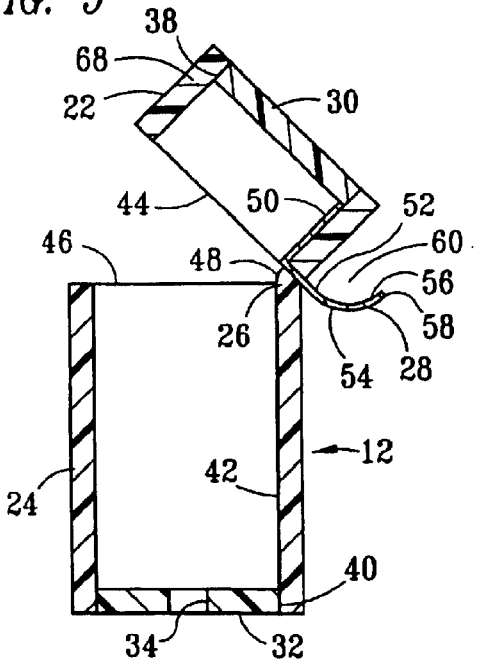
FIG. 5 is sectional view of the insulated beverage holder, taken along section line 5—5 of FIG. 2, and showing the upper portion disposed in an open position relative to a lower portion of the tubular body.

FIG. 4 is a bottom view of the insulated beverage holder 12, and shows a lower enclosure member 32 secured in the lower end 18 of the tubular body 14. Preferably, the lower enclosure member 32 fits flush against an interior of the lower end 18 to fully enclose the lower end 18. The lower enclosure member 32 is preferably a planar member having a periphery 40 of cylindrical shape and defines a disk which is adhesively secure in the lower end 18 of the tubular body 14. An aperture extends through a centrally disposed portion of the lower enclosure member 32, preferably concentrically disposed with the longitudinal axis 29 of the tubular body 14. The lower enclosure member 32 is preferably formed of a flexible, elastomeric material, such as neoprene FIG. 5 is sectional view of the insulated beverage holder 12, taken along section line 5—5 of FIG. 2. The upper portion 22 is shown disposed in an open position relative to the lower portion 24 of the tubular body 14, such that the open space defined by the slit 20 separates the rim 44 of the upper portion 22 from the rim 46 of the lower portion 24. A tab aperture 48 extends through the hinge portion 26, preferably perpendicular to the longitudinal axis 29 of the tubular body 14. The tab 28 extends from within the upper portion 22 of the tubular body 14 and through the tab aperture 48 in the flexible hinge portion 26 to define a lever member 52. The tab 28 has an inward retainer member 50, which is preferably secured within the upper portion 22 with an adhesive. The lever member 52 has an inward portion 54 which preferably extends perpendicular to the retainer member 50 and the longitudinal axis 29. An outward portion 56 of the lever member 52 is curved and extends upwards to a terminal end 58 of the lever member 52, spaced apart from an exterior of the upper portion 22 of the tubular member 14 by a space 60. The space 60 is preferably sized such that a user may insert a finger for angularly moving the upper portion 22 with respect to the lower portion 24, and thus provide for one-handed operation of the insulated beverage holder 12 for consuming a drink disposed within the beverage holder 12.

Figure 6:
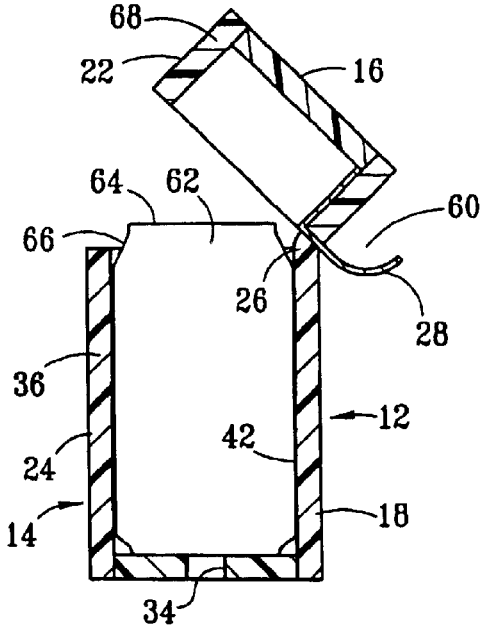
FIG. 6 is sectional view of the insulated beverage holder, taken along section line 5—5 of FIG. 2, showing the upper portion disposed in an open position relative to a lower portion of the tubular body and a beverage container disposed within the insulated beverage holder.
Figure 7:
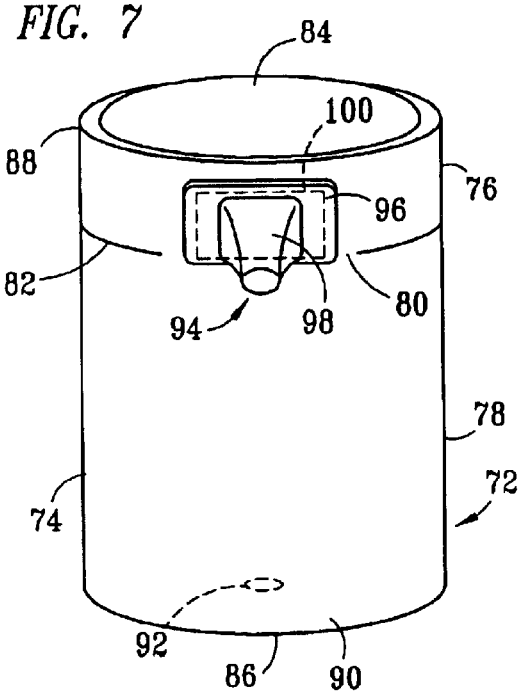
FIGS. 7 through 11 are various views of an alternate insulated beverage holder having a first alternate tab for opening and closing an upper portion relative to a lower portion of the first alternate insulated beverage holder.
Figure 8:
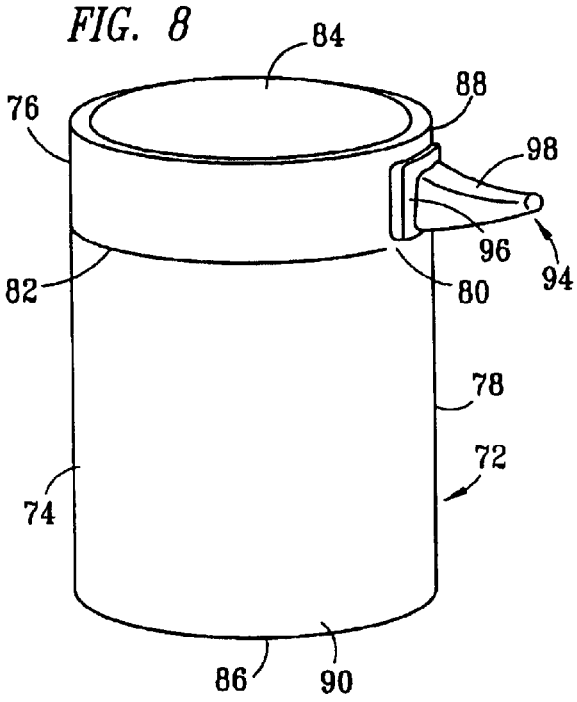
Figure 9:
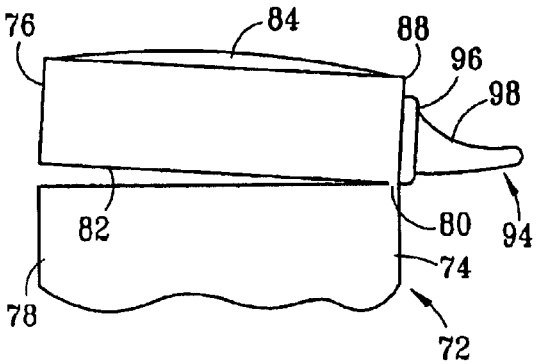
Figure 10:
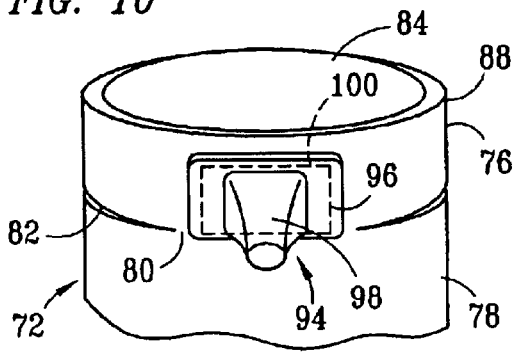
Figure 11:
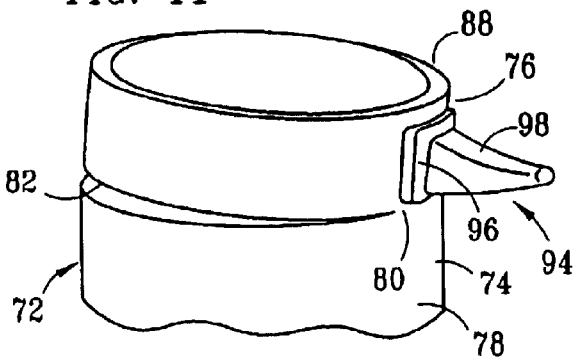

FIG. 6 is sectional view of the insulated beverage holder 12, taken along section line 5—5 of FIG. 2, showing the upper portion 22 disposed in an open position relative to a lower portion 24 of the tubular body 14, with a beverage container 62 disposed within the lower portion 24 of the tubular member 14. The beverage container 62 has an upper end 64 and a periphery 66. Preferably, the beverage container 62 is cylindrical in shape, and the upper end 64 is opened for consumption of the beverage held within the container 62. The interior surface 42 of the sidewall 36 of the tubular body 14 will preferably fit flush against the periphery 66 of the beverage container 62. The aperture 34 in the lower enclosure member 34 allows air to pass from the space between the bottom of the container 62 and the interior of the tubular body 14, and the exterior of the beverage holder 12, as the beverage container 62 is inserted into and removed from within the tubular body 14. The upper portion 22 of the tubular body 14 defines a tubular enclosure 68 which fits over the open, upper end 64 of the beverage container 62. Preferably being formed of a flexible, elastomeric material, such as neoprene, the tubular enclosure 68 will fit snugly over the upper end 64, being able to stretch and conform to the particular shape and size of the beverage container 62. Thus, the interior surface 42 of the upper portion 22 defining the tubular enclosure 68 will fit against the periphery 66 defined by the sidewalls of the beverage container 62.

In operation, upper portion 22 defining the tubular enclosure 68 will be opened and a beverage container 62 will be inserted within the lower portion 24 of the beverage holder 12. The beverage container 62 may be stored within the beverage holder 12, with the upper portion of the tubular body 14 disposed over the upper end 64 of the beverage container 62, prior to the container 62 being opened for consumption of the beverage stored within. Once the beverage container 62 is opened, the upper portion 22 may be closed to seal the upper end 64 the beverage container 62 against contaminants, such as dust, debris and insects, from entering the open, upper end 64. A user may grasp the lower portion 24 of the beverage holder 12 with one hand, inserting an index finger of the hand in the space 60 between the upper portion 22 and the lever arm tab 28. The index finger may be articulated to move the tubular enclosure 68 of the upper portion 22 relative to the upper end 64 of the beverage container 62, to allow access to the upper end 64 for consumption of the beverage within, and then to seal the upper end 64 within the beverage holder 12. This provides for one-handed operation of the insulted beverage container 12, in which a user may flip-open and flip-close the tubular enclosure 68 with the index finger of a hand holding the beverage container 12.

FIGS. 7 through 11 are various views of an alternate insulated beverage holder 72 having an alternate tab 94 for opening and closing an upper portion 76 relative to a lower portion 78 of a tubular body 74 of the alternate insulated beverage holder 72. The upper portion 76 and the lower portion 78 which are pivotally connected by a hinge portion 80. Preferably, the hinge portion 80 is formed of a flexible material which connects between the upper portion 76 and the lower portion 78. In the beverage holder 72 shown, the tubular body 74 is preferably formed of neoprene and the hinge portion 80 connecting between the upper portion 76 and the lower portion 78 is also preferably formed of neoprene. The hinge portion 80 of the beverage holder 72 is preferably provided by a slot 82 which extends into the cylindrical shape of the tubular body 74 to define the upper portion 76 and the lower portion 78. The slot 82 only partially extends into the cylindrical shaped defined by the tubular body 74 to leave a remaining portion which provides the hinge portion 80. The material forming the tubular body 74 is first stamped as a flat sheet, to form the periphery of the tubular body 74 and to cut the slot 82 into the flat sheet, and then the flat sheet of material is rolled into a cylindrical shape, with mating ends of the cylindrical shape being adhesively secured together to provide the tubular body 74. Upper and lower enclosure members 84 and 86 are secured in the upper and lower ends 88 and 90, respectively, of the tubular body 74 to seal the ends 88 and 90. Preferably, the lower enclosure member 86 will have an air equalization port 92, similar to the aperture 34 in the lower enclosure 32 of the insulated beverage holder 12.

Figure 12:
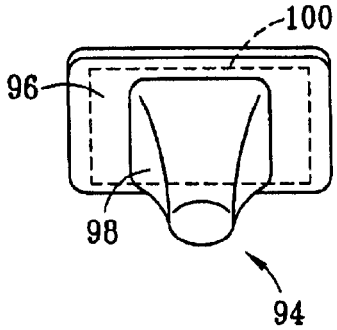
FIG. 12 is a perspective view of the first alternative tab.

FIG. 12 is a perspective view of the tab 94. The tab 94 has a flange 96 and a lever arm 98. The flange 96 extends around three sides of the lever arm 98 and fits against the exterior of the sidewall of the tubular body 74 of the holder 72. The flange 96 is sewn onto the upper portion of the tubular body 74 with stitches 100, preferably on three sides of the lever arm 98. Preferably, the tab 94 is formed of an elastomer, such as SANTOPRENE®, a thermoplastic elastomer available from Advanced Elastomer Systems, L.P. of Akron, Ohio, which is selected to provide sufficient rigidity for the use of the lever arm 98 to open and close the upper portion 76 relative to the lower portion 78, and to allow the flange 96 to be sewn onto the tubular body 74 of the beverage holder 72. The lever arm 98 provides a lever for a user to alternately press against to open and close the upper portion 76 relative to the lower portion 78 of the tubular body 74, providing for one-handed operation.

Figure 13:
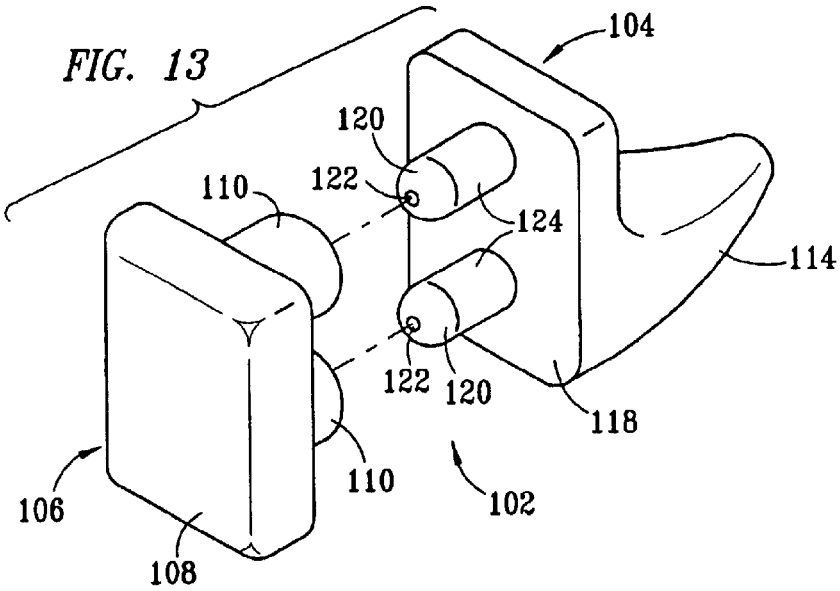
FIGS. 13 and 14 are exploded, perspective views of a second alternate tab assembly, taken from two different angles.
Figure 14:
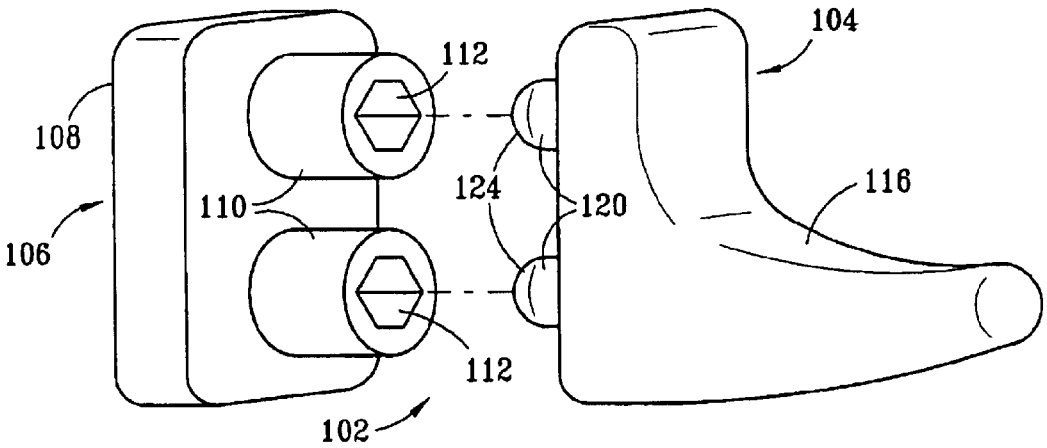

FIGS. 13 and 14 are exploded, perspective views of a second alternate tab assembly 102, taken from two different angles. The tab assembly 102 has a tab member 104 and a fastener member 106. The fastener member 106 includes a planar body portion 108 from which extends the two mounting bosses 110. The mounting bosses 110 have a longitudinal axes which extend at right angles to the planar body portion 108. Mounting sockets 112 are formed into the mounting bosses 100, concentric with respective ones of the longitudinal axes and have profiles which are preferably of hexagonal shape. The tab member 104 includes the lever arm 116 and a planar body portion 118. The lever arm 104 curves in an upward direction as it extends outward from the planar body portion 118. Two mounting posts 120 extend from an opposite side of the planar body portion 118 from that which the lever arm 116 extends. The two mounting posts 120 have blind holes 122 extending therein, concentric with respective longitudinal axes of the mounting posts 120. Peripheries 124 of the mounting posts 120 are preferably of cylindrical shape, and sized for pressing within the sockets 112 having hexagonal shaped profiles, with the sidewall of the tubular body 74 disposed between the planar body portions 108 and 118. In some embodiments, an adhesive may be used rather than a press fit type of engagement to secure the tab member 104 to the fastener member 106.

Figure 15:
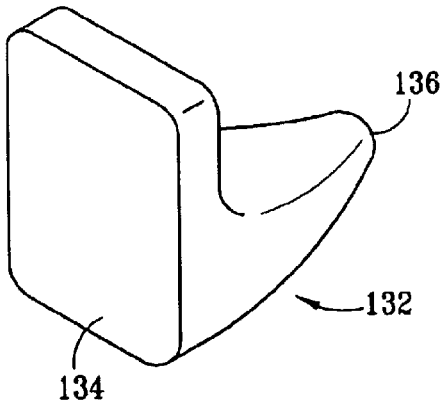
FIGS. 15 and 16 are two perspective views of a third alternative tab, taken from two different angles.
Figure 16:
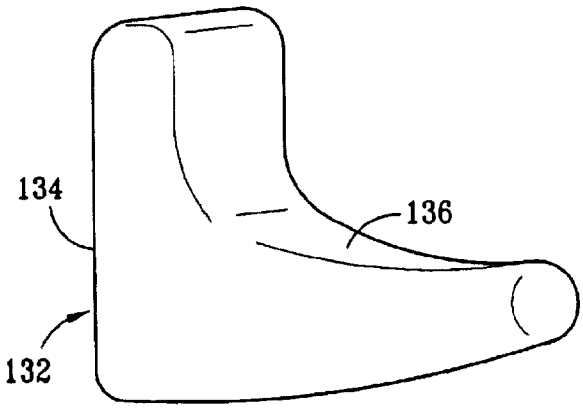

FIGS. 15 and 16 are perspective views of a third alternate tab 132 which has a planar body portion 134 and a lever arm 136 which extends outwardly from the planar body portion 134. The planar body portion may be adhesively secured to the upper portion 76 of the tubular body 74, as opposed to securing the tab member 110 and the fastener member 112 to the tubular body 74. In other embodiments, fasteners may secure the tab 132 to the upper portion 76 of the beverage holder 72, such as threaded fasteners (not shown) which extend through the upper portion 76 and into the planar body portion 134.

In other embodiments, a tab similar to the tab 94 shown in FIG. 12 may have at least one rearwardly extending projection, such as one of the mounting posts 120 shown in FIG. 13. If one of the mounting post is provided, it may be centered within the inward-facing planar surface of the tab 94 which fits against the exterior of the tubular body 74. The one or more post will fit within holes formed through the sidewall of the tubular body 74 for aligning the alternate tab with the tubular body 74, and then retaining the alternate tab against the tubular body 74 while the tab is sewn onto the tubular body 74.

The present invention provides several advantages over prior art insulated beverage holders. The insulated beverage holder of the present invention provides a flip-top, tubular enclosure, which a user may with one hand both hold the beverage holder, and flip-open and flip-close the tubular enclosure with the index finger of the hand holding the beverage holder. The flip-top tubular enclosure will seal the upper end of a beverage container to both insulate the beverage container, and to prevent debris, contaminants and insects from entering the container for later ingestion by a user. The tubular enclosure defined by the upper portion of the beverage holder will seal against the sides fo the beverage container, to assure an adequate seal for preventing debris, contaminants an insects from entering the beverage container.

Although the preferred embodiment has been described in detail, it should be understood that various changes, substitutions and alterations can be made therein without departing from the spirit and scope of the invention as defined by the appended claims.

What is claimed is:

1. An insulated beverage holder for receiving a beverage container and preventing heating of a beverage within the beverage container, the insulated beverage holder comprising:

a tubular body formed of elastomeric material, said tubular body having open upper and lower ends;

an upper enclosure member disposed in said open upper end of said tubular body, extending across and enclosing said upper end of said tubular body;

a lower enclosure member disposed in said lower end of said tubular member, extending across said lower end of said tubular member, said lower enclosure member having an aperture extending there through;

an opening extending into said tubular body, said opening defining an upper portion and a lower portion of said tubular body, said lower portion being of tubular shape for receiving the beverage container and said upper portion defining a tubular enclosure for fitting over the upper end of the beverage container and sealing the beverage container;

a hinge pivotally connecting said upper portion to said lower portion of said tubular body, such that said upper portion is angularly moveable relative to said lower portion between open and closed positions; and a tab mounted to and extending outward of said upper portion of said tubular body, said tab defining a lever member which is engaged by a user to angularly move said upper portion relative to said lower portion of said tubular body.

2. The insulated beverage holder of claim 1, wherein said opening in said tubular member is defined by a slit which is formed to extend partially through said tubular member to define said upper and lower portions, and a remaining portion of said tubular body disposed intermediate between said upper and lower portions defines said hinge.

3. The insulated beverage holder of claim 1, wherein a tab aperture is formed to extend through said hinge, extending through a sidewall of said tubular member, and said tab extends from within said upper portion of said tubular body and through said tab aperture.

4. The insulated beverage holder of claim 3, wherein said tab has an inward retainer member which extends along said sidewall of said upper portion of said tubular body, and a lever member which extends outward of said retainer member, said lever member having an inward portion which extends transverse to said retainer member.

5. The insulated beverage holder of claim 4, wherein said lever member of said tab is arcuately shaped, curving upwards toward a terminal end of said lever member to define an outer portion of said lever member which extends parallel to said retainer member and an exterior periphery of said upper portion of said tubular body, with said lever member being spaced apart from said exterior periphery of said tubular body, such that a user's finger may insert between said terminal end of said tab and said exterior periphery of said upper portion of said tubular body.

6. The insulated beverage holder of claim 5, wherein said tab is formed of a hard plastic material which is adhesively secured to said upper enclosure member.

7. The insulated beverage holder of claim 1, wherein said elastomeric material from which said tubular body is neoprene.

8. The insulated beverage holder of claim 7, wherein said upper and lower enclosure members are formed of neoprene.

9. The insulated beverage holder of claim 7, wherein said tubular body is of cylindrical shape.

10. The insulated beverage holder of claim 9, wherein said upper and lower enclosure members are circular in shape.

11. The insulated beverage holder of claim 10, wherein said upper and lower enclosure members have peripheries which fit interiorly within and flush against an interior of said tubular body, to seal said upper and lower ends.

12. An insulated beverage holder for receiving a beverage container and preventing heating of a beverage within the beverage container, the insulated beverage holder comprising:

a tubular body formed of elastomeric material, said tubular body having open upper and lower ends;

an upper enclosure member disposed in and extending across said open upper end of said tubular body, sealing said upper end of said tubular body;

a lower enclosure member disposed in said lower end of said tubular member, sealing said lower end of said tubular member, said lower enclosure member having an aperture extending there through;

a slit formed into said tubular body and defining upper and lower portions, and a flexible, remaining portion of said tubular body, said flexible, remaining portion being disposed adjacent to said slit and defining a hinge, said lower portion being of tubular shape for receiving the beverage container and said upper portion defining a tubular enclosure for fitting over the upper end of the beverage container and sealing against a side of the beverage container;

said hinge pivotally connecting said upper portion to said lower portion, such that said upper portion is angularly moveable relative to said lower portion;

a tab aperture is formed to extend through said hinge, extending through a sidewall of said tubular member, and said tab extends from within said upper portion of said tubular body and through said tab aperture;

a tab mounted to and extending from within said upper portion of said tubular body, through said tab aperture and outward of said upper portion of said tubular body, said tab defining a lever member which is engaged by a user to angularly move said upper portion relative to said lower portion of said tubular body; and said tab having an inward retainer member which extends along said sidewall of said upper portion of said tubular body, and a lever member which extends outward of said retainer member, said lever member having an inward portion which extends transverse to said lever member.

13. The insulated beverage holder of claim 12, wherein said lever member of said tab is arcuately shaped, curving upwards toward a terminal end of said lever member to define an outer portion of said lever member which extends parallel to said retainer member and an exterior periphery of said upper portion of said tubular body, with said lever member being spaced apart from said exterior periphery of said tubular body, such that a user's finger may insert between said terminal end of said tab and said exterior periphery of said upper portion of said tubular body.

14. The insulated beverage holder of claim 3, wherein said tab is formed of a hard plastic material which is adhesively secured to said upper enclosure member.

15. The insulated beverage holder of claim 12, wherein said elastomeric material of said tubular body is formed of neoprene, and said upper and lower enclosure members are formed of neoprene.

16. The insulated beverage holder of claim 12, wherein said tubular body is of cylindrical shape, said upper and lower enclosure members are circular in shape, and have peripheries which fit interiorly within and flush against an interior of said tubular body.

17. An insulated beverage holder for receiving a beverage container and preventing heating of a beverage within the beverage container, the insulated beverage holder comprising:

a tubular body of cylindrical shape formed of elastomeric material, said tubular body having open upper and lower ends;

an upper enclosure member having a planar body formed of elastomeric material and having a circular shape, said upper enclosure member disposed in said open upper end of said tubular body and fitting flush against an interior of said tubular body, sealing said upper end of said tubular body;

a lower enclosure member having a planar body formed of elastomeric material and having a circular shape, said lower enclosure member disposed in said lower end of said tubular member and fitting flush against an interior of said tubular body, sealing said lower end of said tubular member, said lower enclosure member having an aperture extending there through;

a slit formed into said tubular body to define an opening which extends partially into said tubular body, between an upper portion and a lower portion of said tubular body, said lower portion being of tubular shape for receiving the beverage container and said upper portion defining a tubular enclosure for fitting over the upper end of the beverage container and sealing against a side of the beverage container;

said slit only partially extending across said tubular body to provide a flexible, remaining portion of said tubular body disposed adjacent to said slit defines a hinge which connects said upper portion to said lower portion of said tubular body, such that said upper portion is angularly moveable relative to said lower portion and over the upper end of the beverage container for sealing against the side of the beverage container;

a tab aperture is formed to extend through said flexible hinge; and a tab formed of plastic material and mounted to and extending from within said upper portion of said tubular body, through said tab aperture and outward of said upper portion of said tubular body, said tab defining a lever member which is engaged by a user to angularly move said upper portion relative to said lower portion of said tubular body.

18. The insulated beverage holder of claim 17, wherein said tab has an inward retainer member which extends along said sidewall of said upper portion of said tubular body, and a lever member which extends outward of said retainer member, said lever member having an inward portion which extends transverse to said lever member.

19. The insulated beverage holder of claim 18, wherein said lever member of said tab is arcuately shaped, curving upwards toward a terminal end of said lever member to define an outer portion of said lever member which extends parallel to said retainer member and an exterior periphery of said upper portion of said tubular body, with said lever member being spaced apart from said exterior periphery of said tubular body, such that a user's finger may insert between said terminal end of said tab and said exterior periphery of said upper portion of said tubular body.

20. The insulated beverage holder of claim 19, wherein said elastomeric material from which said tubular body is formed is neoprene, and said upper and lower enclosure members are formed of neoprene.

* * * * *